US007244190B2

(12) United States Patent
McCracken

(10) Patent No.: US 7,244,190 B2
(45) Date of Patent: Jul. 17, 2007

(54) GOLF PUTTER

(76) Inventor: Russell D. McCracken, R.R.#2, Zurich, Ontario (CA) N0M 2T0

( * ) Notice: Subject to any disclaimer, the term of this patent is extended or adjusted under 35 U.S.C. 154(b) by 0 days.

(21) Appl. No.: 11/020,105

(22) Filed: Dec. 27, 2004

(65) Prior Publication Data

US 2006/0142094 A1 Jun. 29, 2006

(51) Int. Cl.
*A63B 53/02* (2006.01)

(52) U.S. Cl. ..... 473/313; 473/314

(58) Field of Classification Search ..... 473/313–314, 473/340–341, 293
See application file for complete search history.

(56) References Cited

U.S. PATENT DOCUMENTS 1,631,504 A * 6/1927 Redman ..... 473/313
2,478,468 A * 8/1949 Drake ..... 473/313
4,163,554 A * 8/1979 Bernhardt ..... 473/255
4,361,329 A * 11/1982 Brock ..... 473/286
4,664,385 A * 5/1987 Macera ..... 473/340
4,921,253 A * 5/1990 Tesori ..... 473/341
5,409,220 A * 4/1995 Lombardo ..... 473/312
5,454,564 A * 10/1995 Kronogard ..... 473/201
6,450,903 B1 * 9/2002 Tate ..... 473/406
6,497,626 B1 * 12/2002 Sundberg ..... 473/248
7,066,829 B1 * 6/2006 Lister ..... 473/314
7,083,525 B2 * 8/2006 Pond et al. ..... 473/251
2002/0123385 A1 * 9/2002 Primiano et al. ..... 473/220
2002/0151376 A1 * 10/2002 Verne ..... 473/314
2003/0236130 A1 * 12/2003 Gammon, Jr. ..... 473/293

* cited by examiner

*Primary Examiner*—Stephen Blau
(74) *Attorney, Agent, or Firm*—Daryl W. Schnurr

(57) ABSTRACT

A golf putter has a head and a shaft connected to the head at a toe end. The head has an L-shaped cross section and a lower edge of a putting surface is smoothly curved with a lowermost point at an approximate midpoint between the toe and a heel of the head. The head has a hosel thereon that is integral with the head for receiving the shaft at a fixed angle. The shaft is straight.

17 Claims, 4 Drawing Sheets

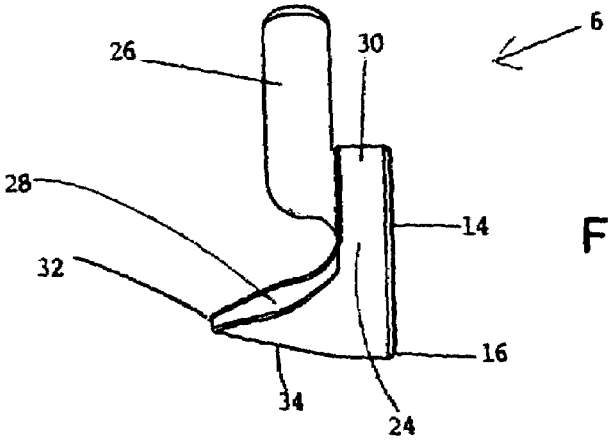
FIGURE 3
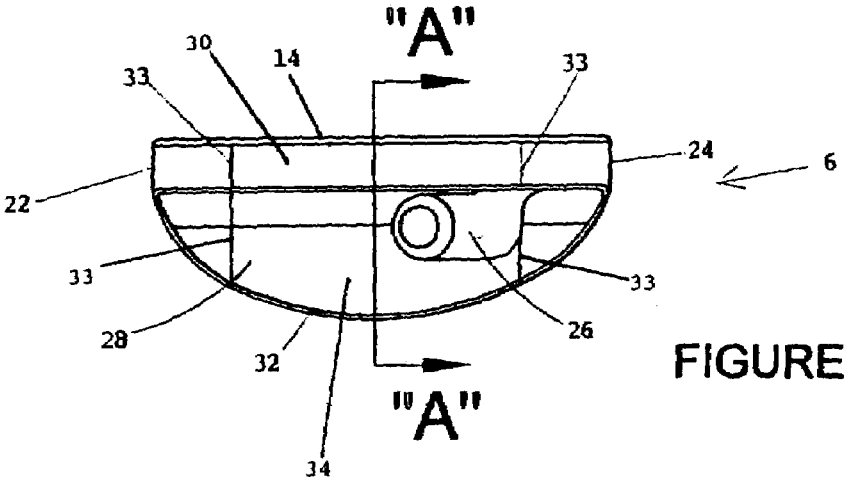
FIGURE 4
FIGURE 5
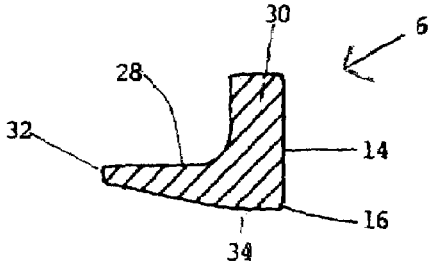

GOLF PUTTER

This application claims priority on the Canadian Formal Application 2490911 filed Dec. 23, 2004.

BACKGROUND OF THE INVENTION

1. Field of the Invention

This invention relates to a golf putter having a head with a heel and a toe and a shaft attached to the head at or near the toe. The head has a putting surface that is smoothly curved from heel to toe with a lowermost point located at or near a midpoint.

2. Description of the Prior Art

Golf putters are one of the most common and necessary golf clubs and putting is an extremely important part of the game of golf. Golf putters have various shapes and sizes and there is a continuous quest to create an improved putter that enables a user to putt a golf ball more accurately. Most putters have a shaft that is connected at or near a heel of the head. Golfers using existing putters often have difficulty lining up the putter with the ball and the cup, or the putters do not provide a smooth stroke to the golf ball, or the putters tend to move out of alignment when the golf ball is struck, or the golf ball tends to bounce on the putting surface after it is struck, thereby resulting in a missed putt, or the putter does not provide a high degree of comfort and confidence to the user.

A putter that has a shaft connected to the head at a toe of the head is described in U.S. Pat. No. 6,723,002 issued on Apr. 20, 2004 and naming Barlow as an inventor. The head is divided into three solid bodies with the middle solid body being much larger than the two outer solid bodies. The shaft is inserted perpendicularly into a bore in the outer solid body at the toe and is bent at an angle of ten to twenty degrees at one to four inches above the top surface of the head toward the user. The head has a flat ball-striking surface. The main body has a top surface and a bottom surface that both have a straight front edge at the ball-striking surface. Putters with bent shafts can be more difficult to line up with the cup when putting a golf ball. Putters with a straight lower edge are more difficult to use by persons of different heights as the angle of the straight edge to the putting surface varies with the height of the user.

SUMMARY OF THE INVENTION

It is an object of the present invention to provide a golf putter with shaft connected to a head at or near a toe of the head and the head having a lower edge that is curved to make the putter readily adjustable for users having different heights. It is a further object of the invention to provide a putter that is well-balanced, can be easily lined up with the ball land the cup, is sufficiently stable that it does not tend to become misaligned when the ball is struck and results in a more accurate putting stroke.

A putter for use by a user in putting a golf ball on a putting surface comprises a shaft and a head. The shaft has an upper end and a lower end and the head has a ball striking surface with a sweet spot on the surface. The shaft is connected to the head at a location that is at or near the toe. The ball striking surface has a lower edge that is smoothly curved from a heel to the toe with a lowest point on the lower edge at or near a midpoint between the heel and the toe.

A putter is used by a user in putting a golf ball on a putting surface and comprises a shaft and a head. The shaft has a handle end and a lower end. The head has a ball striking surface with a sweet spot on the surface. The head has a base extending rearwardly from a lower edge of the ball striking surface. The ball striking surface is located on a front wall that is less than half as thick as the distance from a front to a rear of the base through a center of the sweet spot. The head has a generally L-shaped cross section through the center of the sweet spot. The lower end of the shaft is affixed to the head at a location that is beyond the center of the sweet spot at or near the toe.

A putter for use by a user in putting a golf ball on a putting surface has a shaft and a head. The shaft has a handle and a lower end. The head has a ball striking surface with a sweet spot on the surface. The shaft is straight between the handle and the head and is connected to the head at a location that is at or near the toe. The shaft is located at an angle of less than 90 degrees to the putting surface when the head is located approximately equal distance from the head and the toe above the putting surface.

BRIEF DESCRIPTION OF THE DRAWINGS

FIG. 3 is an end view of the head when viewed from the toe;

FIG. 4 is a top view of the head;

FIG. 5 is a sectional view of the head along the lines A-A of FIG. 4;

DETAILED DESCRIPTION OF A PREFERRED EMBODIMENT

Figure 1:
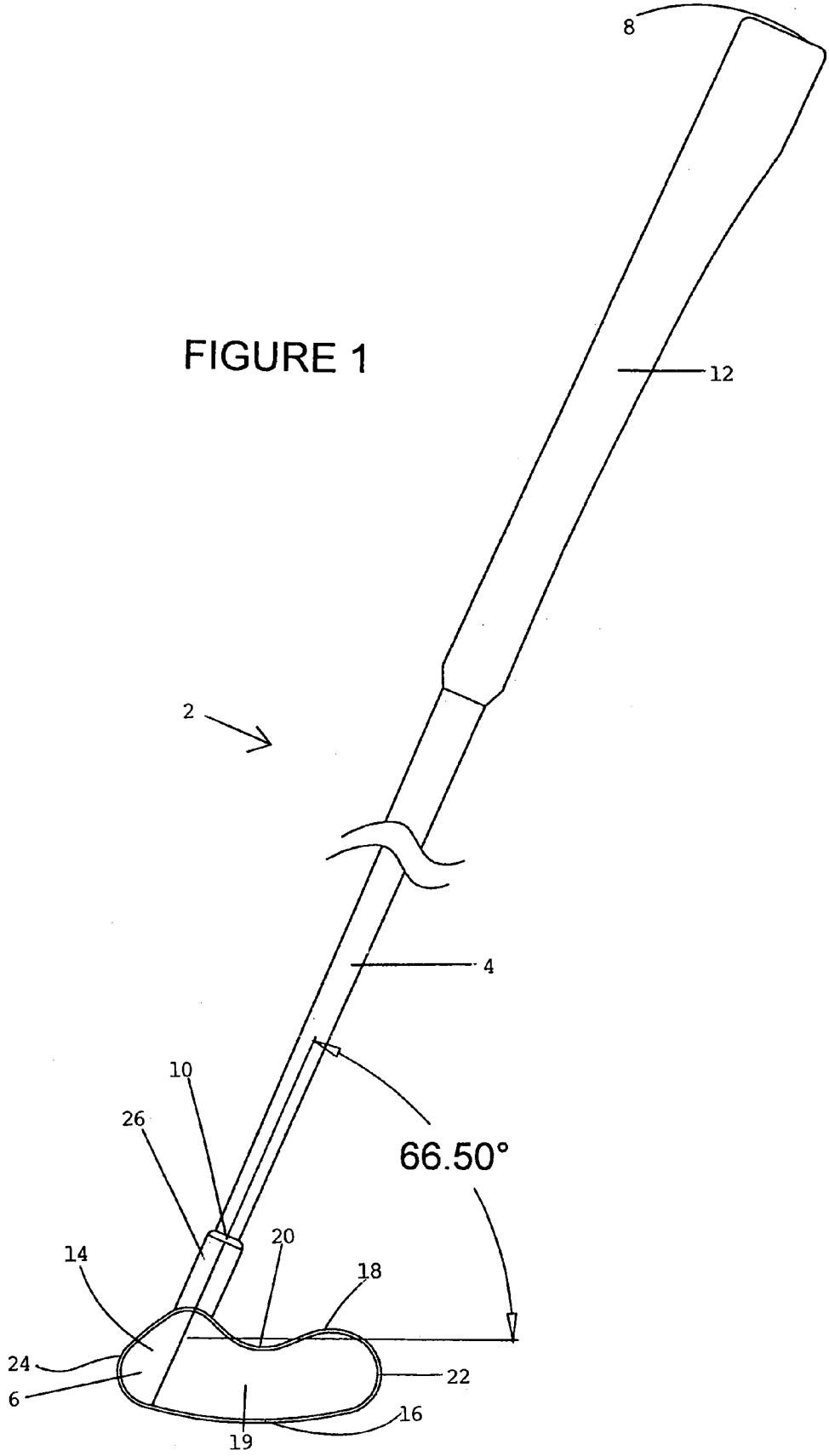
In FIG. 1, there is shown a partial perspective view of a right handed putter when viewed from a front.
Figure 2:
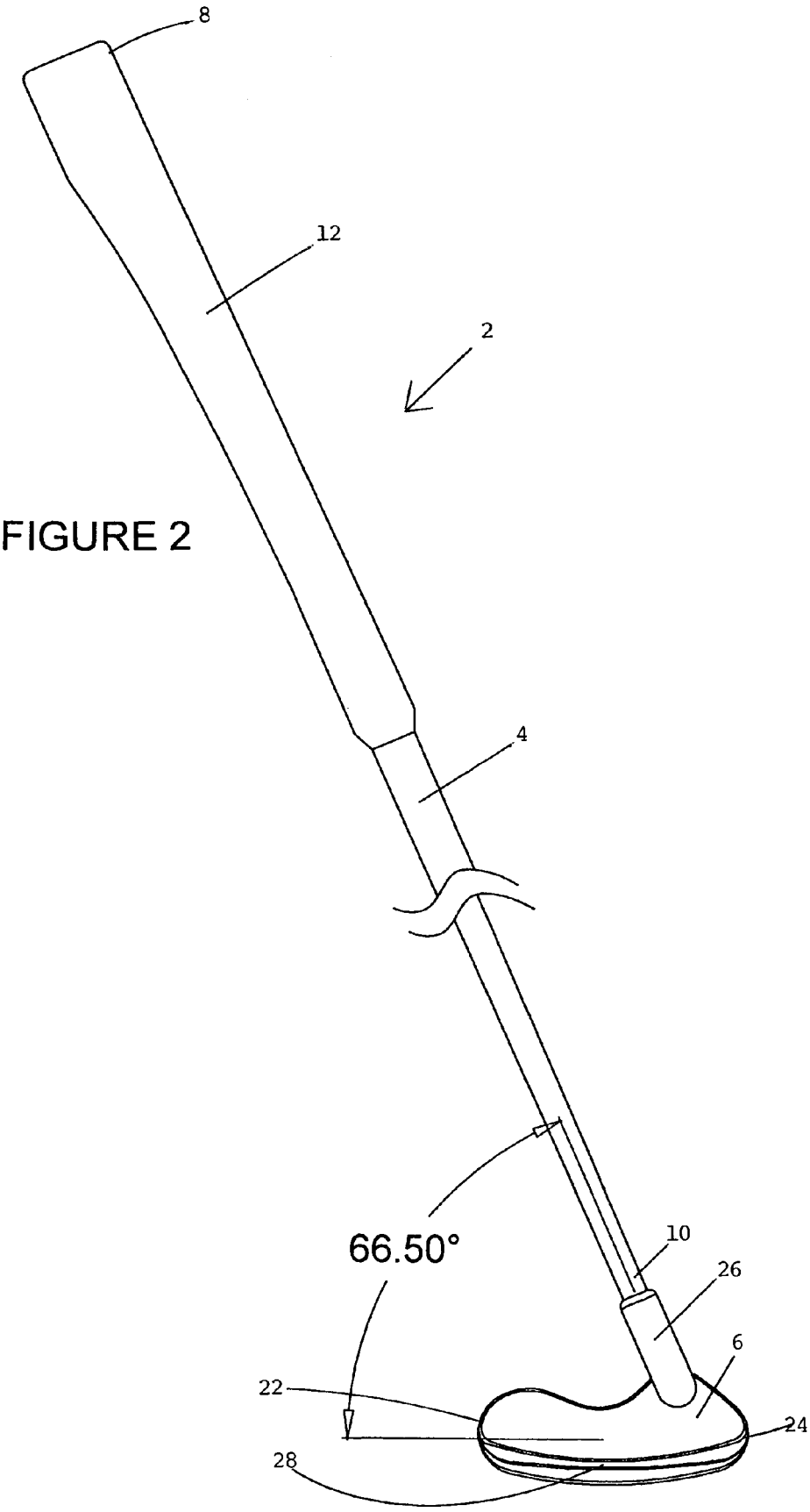
FIG. 2 is a partial perspective view of a right handed putter when viewed from a rear.

As shown in FIGS. 1 and 2, a putter 2 has a shaft 4 and head 6. The shaft 4 has an upper end 8 and a lower end 10. A handle 12 is located at the upper end 8. When describing FIGS. 1 and 2 the head 6 has a putting surface 14 at a front thereof with a lower edge 16 and an upper edge 18. The putting surface 14 has a sweet spot 19 in a central area thereof between the heel and toe. The upper edge 18 has a cutaway portion 20 at or near a midpoint between a heel 22 and a toe 24. A hosel 26 is integral with the head 6 and extends at an angle to the head 6 of less than 90 degrees when the heel 22 and toe 24 are located equidistant above a putting surface (not shown). The head 6 has a rear 28.

In FIGS. 3 to 7, the same reference numerals are used as those used in FIGS. 1 and 2 for those components that are identical. The putting surface 14 is located on a front wall 30 that extends less than half way between the putting surface 14 and a rear edge 32. The head 6 has a base 34 that extends rearward and slightly upward relative to the lower edge 16 of the putting surface 14. It can be seen from FIG. 3 that the hosel 26 is approximately midway between the putting surface 14 and the rear edge 32.

Figure 6:
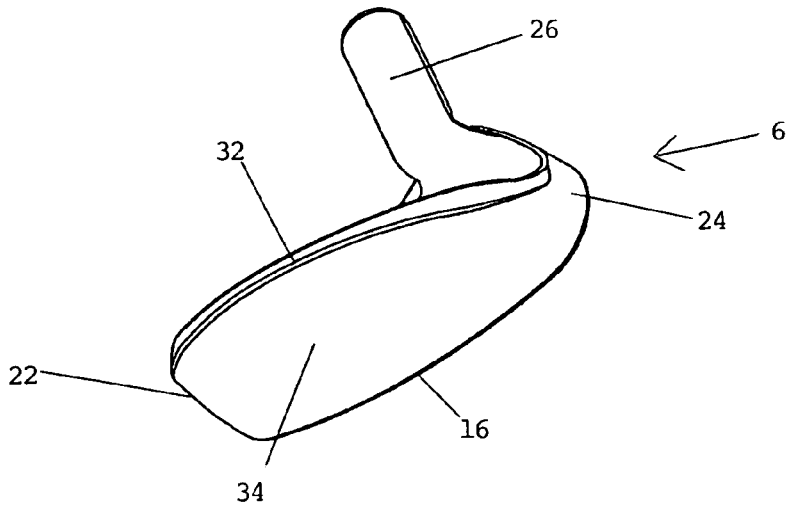
FIG. 6 is a perspective view of the head when viewed from a base.
Figure 7:
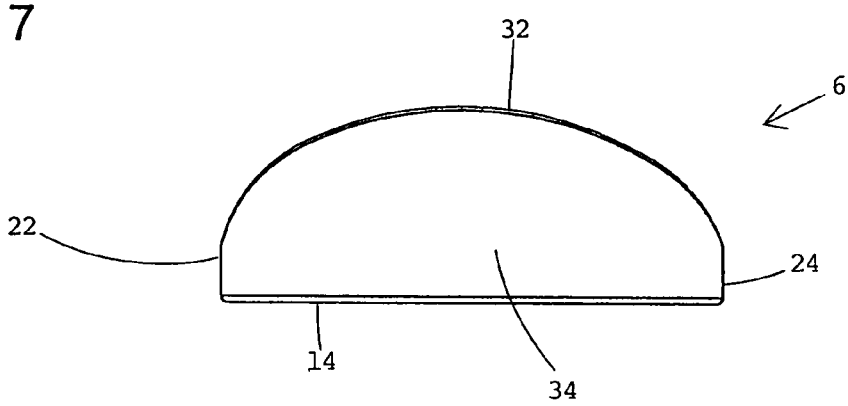
FIG. 7 is a bottom view of the head.

In FIG. 4 there is shown a top view of the head 6 and FIG. 5 shows a sectional view through a midpoint of the head 6 along the lines A-A of FIG. 4. From the sectional view, it can be seen that the head has an L-shaped cross section. In FIG. 5, the "L" is a reverse "L", but the cross section would be a mirror image of that shown in FIG. 5 if the cross section was viewed from the heel 22 rather than the toe 24. In FIGS. 6 and 7, the curvature of the base 34 and rear edge 32 is shown in more detail. Preferably, the putter has three markings (not shown) on a top of the front wall 30 and rear 28. The centre marking would be located beneath the section line A-A, but is above a center of the sweet spot. Two outer markings 33 on the front wall 30 and base 34 would be aligned with outer edges of the sweet spot. The rear 28 and rear edge 32 can be extended beyond that shown in FIGS. 1 to 7. The cutaway portion 20 is removed to make the head lighter and to achieve a pleasing appearance and better balance. An upper portion of the front wall 30 decreases in height at a centre of said surface 14 for at least one-quarter of a length of said head 6. As can be seen from the drawings, the cutaway portion is smoothly curved and the height at said centre is reduced. Since the shaft is straight and extends directly into the hosel, the shaft can be used by a user to line up the putter with the ball and the cup (not shown). Since the hosel is integral with the head and the shaft is straight, the angle of the shaft to the head is constant and repeatable with different heads and shafts. During assembly, the shaft is inserted into the hosel and the correct angle is automatically achieved. As shown in FIGS. 1 and 2, the angle of the shaft to a putting surface (not shown) when the heel and toe are approximately equidistant above the putting surface is less than 90 degrees and is substantially 66.5 degrees.

The actual angle of the shaft to the putting surface during use of the putter will be determined by a particular user. The actual angle will vary for different users and will even vary for the same user. The design of the putter provides the user with a wide range of angles while still enabling the user to line up the line of sight vertically above the ball. Preferably, the head is cast and is made of a suitable metal. Stainless steel is one metal that can be used for the head. Preferably, the putting surface is flat and the putting surface and base have a polished finish. Preferably, the remainder of the head is not polished and has a dull finish. Since the shaft is connected at or near the toe, the head and the ball is closer to the feet of a user (not shown) than it would be if the shaft was connected to the heel of the head. Also, greater control is achieved and the club has less of a tendency to move out of alignment when the ball is struck. The putter design makes it easier for a user to look vertically down to the ball during the putting stroke.

The putter shown in the drawings is a right-handed putter. A left-handed putter is a mirror image of the putter shown.

I claim:

1. A putter for use by a user in putting a golf ball on a putting surface, said putter comprising a shaft and a head, said shaft having a handle and a lower end, said head having a ball striking surface with a sweet spot on said surface, said head having a base extending rearward from a lower edge of said ball striking surface, said ball striking surface being located on a front wall that is less than half as thick as a distance from a front to a rear of said base through said sweet spot, said head having a generally L-shaped cross-section through said sweet spot, a lower end of said shaft being affixed to said head at a location that is at or near said toe, said shaft being straight between said handle and said head, an upper portion of said front wall decreasing in height at a centre of said surface for at least one-quarter of a length of said head, and said head has a receptor thereon to receive said shaft wherein said receptor is located to a rear of said front wall.

2. A putter as claimed in claim 1 wherein said shaft is connected to said putter at an angle of less than ninety degrees relative to said putting surface when said heel and said toe are substantially equidistant from said putting surface.

3. A putter as claimed in claim 2 wherein said angle is substantially 66.5 degrees.

4. A puller as claimed in claim 3 wherein said receptor is a hosel that is integral with said head, said hosel having a passage that is angled appropriately so that when the shaft is inserted into said channel, the shaft is at the correct angle.

5. A putter as claimed in claim 4 wherein said passage in said hosel is parallel to said ball striking surface.

6. A putter as claimed in claim 3 wherein said base extends rearward from said ball striking surface beyond said receptor.

7. A putter as claimed in claim 1 wherein said ball striking surface has a lower edge that is smoothly curved from heel to toe with a central portion being lower than heel and toe portions.

8. A putter as claimed in any one of claims 1, 2 or 3 wherein said head is made from stainless steel.

9. A putter as claimed in claim 1 wherein said base is angled slightly upward away from said ball striking surface.

10. A putter as claimed in claim 1 wherein there is at least one marking on an upper surface of said wall to indicate a location of said sweet spot.

11. A putter as claimed in claim 1 wherein there is several markings on an upper surface of said wall and said base to indicate a location of said sweet spot.

12. A putter as claimed in claim 1 wherein said head is cast from metal.

13. A putter as claimed in claim 1 wherein said location is to a rear of said putting surface by a distance of approximately equal to a diameter of said shaft at said lower end.

14. A putter as claimed in claim 1 wherein said location is to a rear of said front wall.

15. A putter as claimed in claim 14 wherein there is a hosel at said location to receive said shaft, said hosel being aligned with said shaft and being at an angle of less than 90 degrees to said putting surface when said heel and said toe are approximately equidistant from said putting surface.

16. A putter for use by a user in putting a golf ball on a putting surface, said putter comprising a shaft and a head, said shaft having a handle and a lower end, said head having a ball striking surface with a sweet spot on said surface, said shaft being straight between said handle and said head and said lower end and being connected to said head at a location that is at or near said toe, said shaft being located at an angle of substantially 66.5 degrees to said putting surface when said heel and toe are located approximately equidistant above said putting surface, said head having an L-shaped cross-section through said sweet spot, said ball striking surface on a front wall with an upper portion of said front wall decreasing in height at a center of said surface for at least one-quarter of a length of said head, and said head has a receptor thereon to receive said shaft wherein said receptor is located to a rear of said front wall.

17. A putter as claimed in claim 16 wherein said ball striking surface has a lower edge that is smoothly curved from heel to toe, with a center portion of said ball striking surface being lower than said heel and toe portions.

* * * * *